US005655227A

United States Patent [19]

Sundberg et al.

[11] Patent Number: 5,655,227

[45] Date of Patent: Aug. 12, 1997

[54] METHOD OF FITTING SHOCK-ABSORBING PADDING TO A HELMET SHELL AND A HELMET PROVIDED WITH SUCH PADDING

[76] Inventors: Reino Sundberg, Tallstigen 3 A, S-146 00 Tullinge; Dick Drott, Roddarvägen 47, S-141 41 Huddinge, both of Sweden

[21] Appl. No.: 530,343

[22] PCT Filed: Apr. 6, 1994

[86] PCT No.: PCT/SE94/00307

§ 371 Date: Oct. 6, 1995

§ 102(e) Date: Oct. 6, 1995

[87] PCT Pub. No.: WO94/22337

PCT Pub. Date: Oct. 13, 1994

[30] Foreign Application Priority Data

Apr. 7, 1993 [SE] Sweden ..... 9301165

[51] Int. Cl.[6] ..... A42B 3/00

[52] U.S. Cl. ..... 2/414; 2/425

[58] Field of Search ..... 2/410, 411, 412, 2/414, 425, 417, 424, 9; 264/222

[56] References Cited

U.S. PATENT DOCUMENTS

| | | | |
|---|---|---|---|
| 2,706,294 | 4/1955 | Sprinkle | 2/414 |
| 2,717,384 | 9/1955 | Frothingham | 2/414 |
| 4,020,507 | 5/1977 | Morton | 2/411 |
| 4,044,399 | 8/1977 | Morton | 2/414 |
| 4,432,099 | 2/1984 | Grick et al. | 2/412 |
| 4,627,114 | 12/1986 | Mitchell et al. | 2/414 |
| 5,056,162 | 10/1991 | Tirums | 2/412 |
| 5,129,108 | 7/1992 | Copeland et al. | 2/424 |
| 5,148,550 | 9/1992 | Hodgkinson et al. | 2/424 |
| 5,175,889 | 1/1993 | Infusino | 2/425 |
| 5,271,103 | 12/1993 | Darnell | 2/425 |
| 5,324,460 | 6/1994 | Briggs | 2/414 |

FOREIGN PATENT DOCUMENTS 462735 8/1990 Sweden .

*Primary Examiner*—Michael A. Neas

*Attorney, Agent, or Firm*—Sughrue, Mion, Zinn, Macpeak & Seas

[57] ABSTRACT

A helmet shell, particularly a face mask for ice-hockey goal tenders, has an impact-absorbing padding adapted to the individual shape of the wearer's head. A padding blank is first cut from a sheet of thermoplastic material of suitable hardness and the blank is heated to a temperature at which it softens so as to become easily shaped. The blank is then placed in the helmet shell and the shell is placed on the head of the intended wearer and pressed down against the head with a force sufficient for the blank to be brought to the shape of the head and of the helmet shell. This force is maintained until the blank cools to a temperature at which the material retains its shape, whereafter the padding is affixed to the helmet shell with the aid of fasteners applied to the helmet shell and/or the padding.

4 Claims, 2 Drawing Sheets

METHOD OF FITTING SHOCK-ABSORBING PADDING TO A HELMET SHELL AND A HELMET PROVIDED WITH SUCH PADDING

BACKGROUND OF THE INVENTION

The present invention relates to a method of fitting shock-absorbing padding to a helmet shell or like structure, particularly to face masks for ice-hockey goal tenders, while adapting the padding individually to the shape of the wearer's head. The invention also relates to a helmet provided with such padding.

Progressively more ice-hockey goal tenders are changing from the use of grid-fitted helmets to the use of full face masks provided with small eye openings or with a larger opening which is covered by a grid or visor, so as to protect the face of the wearer. The face protecting part of the mask is formed integrally with a helmet shaped part, which protects the crown and sides of the head. The neck is normally protected by means of a back plate attached to the helmet shell.

Since a puck can strike the mask with considerable force as a result of a direct hit, the material from which the mask shell is made must be very strong. Recommendations have been published which stipulate the smallest distance between the mask shell and the various parts of the face and head. In order to enable the force from a puck for instance to be transmitted and absorbed by the head in the best possible manner, it is necessary to provide the helmet with soft, impact or shock-absorbing padding between the helmet shell and the head, this padding being well-adapted to the shape of the head and the helmet shell.

In the case of commercially available standard face masks it is normal for the wearer himself/herself to adapt individually the padding to the shape of his/her own head. This may require the insertion of additional pieces of padding material at different positions in the helmet, and also may require parts of the existing material to be cut away at other locations. The work involved in this regard is highly laborious and still does not provide a fully satisfactory result. There is also a danger that the padding material will be much too thin at those areas where material has been removed, causing the helmet shell to lie too close to the head.

Another method of adapting a standard helmet shell to the shape of an individual is to fit the shell with air bladders or bags which are inflated each time the helmet is used. This method also suffers certain drawbacks, however.

In the case of a more sophisticated method of adapting face masks to suit the individual, this method being used in U.S.A. and Canada among other countries, a plaster cast is made of the wearer's face and the helmet shell is shaped to the plaster cast, although somewhat enlargened so as to provide room for the shook-absorbing padding. This method is very expensive and time-consuming and cannot be applied with the large majority of goal tenders, or goal keepers.

SUMMARY OF THE INVENTION

The main object of the present invention is to provide a method by means of which a standard face mask can be provided with individually adapted padding which will fit the head of the wearer exactly so as to obtain maximum safety and maximum comfort.

The padding is preferably made of a thermoplastic material of the cellular polyethylene type, i.e. expanded polyethylene which includes closed cells. This material is completely impervious to air and water vapour and provides effective impact damping as a result of the gas enclosed in the closed cell structure. As a result of the relatively high moulding temperature, about 160° C., recommended in connection with industrial moulding in presses of different types, it has been considered necessary to pre-shape the padding and then mount and affix the padding in the helmet shell, which results in a less than satisfactory fit on the wearer's head.

The present invention is based on the realization that the problems of a poor fit can be eliminated by using the wearer's head as one part of a "mould tool" or die and the helmet shell as the other part of the mould tool. Fundamental hereto is the discovery that the material used in the moulding process need not be heated to the high temperature recommended for use in industrial moulding processes, but can be brought to the requisite degree of softness, and therewith shapeability, at a much lower temperature, provided that the material is heated throughout its thickness. The material can be heated in a typical domestic oven or like device. Lower temperatures require longer heating times.

Tests have shown that it is normally possible to use much higher heating temperatures than would be expected. This is explained, among other things, by the fact that the surface of the material cools very rapidly when the material is removed from the oven. This enables oven temperatures of up to 150° C. to be used. When the person concerned has very sensitive skin, the skin can be protected with a thin gauze stocking, for instance, during the actual moulding process.

According to the present invention, a method of providing a helmet shell or the like with individually adapted shock-absorbing padding as defined in the first paragraph is mainly characterized by

- cutting a padding blank from a sheet of thermoplastic material of appropriate hardness;
- heating the blank to a temperature at which it softens and becomes readily moldable;
- placing the blank in the helmet shell;
- placing the helmet shell carrying the blank on the head of the intended wearer;
- pressing the helmet against the wearer's head with a force sufficient to mold the blank to the shape of the wearer's head and to the shape of the helmet shell;
- maintaining said force until the blank has cooled to a temperature at which the material will retain its molded shape; and
- affixing the padding to the helmet shell with the aid of fastening means applied to the helmet shell and/or the padding.

The method thus enables a standard helmet shell to be fitted with padding which is adapted individually to the shape of the wearer's head and to the shape of the helmet shell, thereby optimizing the protection afforded by the helmet and also the comfort with which the helmet can be worn.

As before mentioned, the thermoplastic material used will preferably be cellular polyethylene having a closed cellular structure.

The blank is conveniently heated in an oven at a temperature of 100°–150° C. for 5–20 minutes. According to one preferred embodiment, the material is heated at 125° C., for about 10 minutes.

DETAILED DESCRIPTION OF THE PREFERRED EMBODIMENTS

Figure 1:
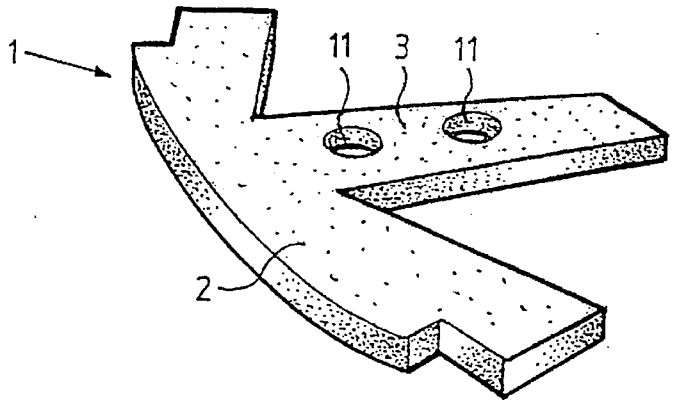
FIG. 1 illustrates a blank from which helmet padding is produced in accordance with the invention.

The blank 1 shown in FIG. 1 has a generally T-shape and has been punched from a flat sheet of cellular polyethylene having closed cells, i.e. a low density expanded and cross-linked polyethylene. A volumetric weight of 70 kg/m$^3$ has been found to provide suitable impact-absorbing properties combined with good wearing comfort. However, higher and lower volumetric weights may also be used, and the padding may be comprised of several layers of mutually different volumetric weights, in which case the best comfort is achieved when the layer that lies in contact with the head has the lowest volumetric weight.

Depending on the configuration of the helmet shell, it may be necessary to slightly modify the T-shape shown in FIG. 1, although it is important that the padding includes a part 2 which lies against the forehead and the sides of the head of the wearer, and a part 3 which lies against the crown of the wearer.

Figure 2:
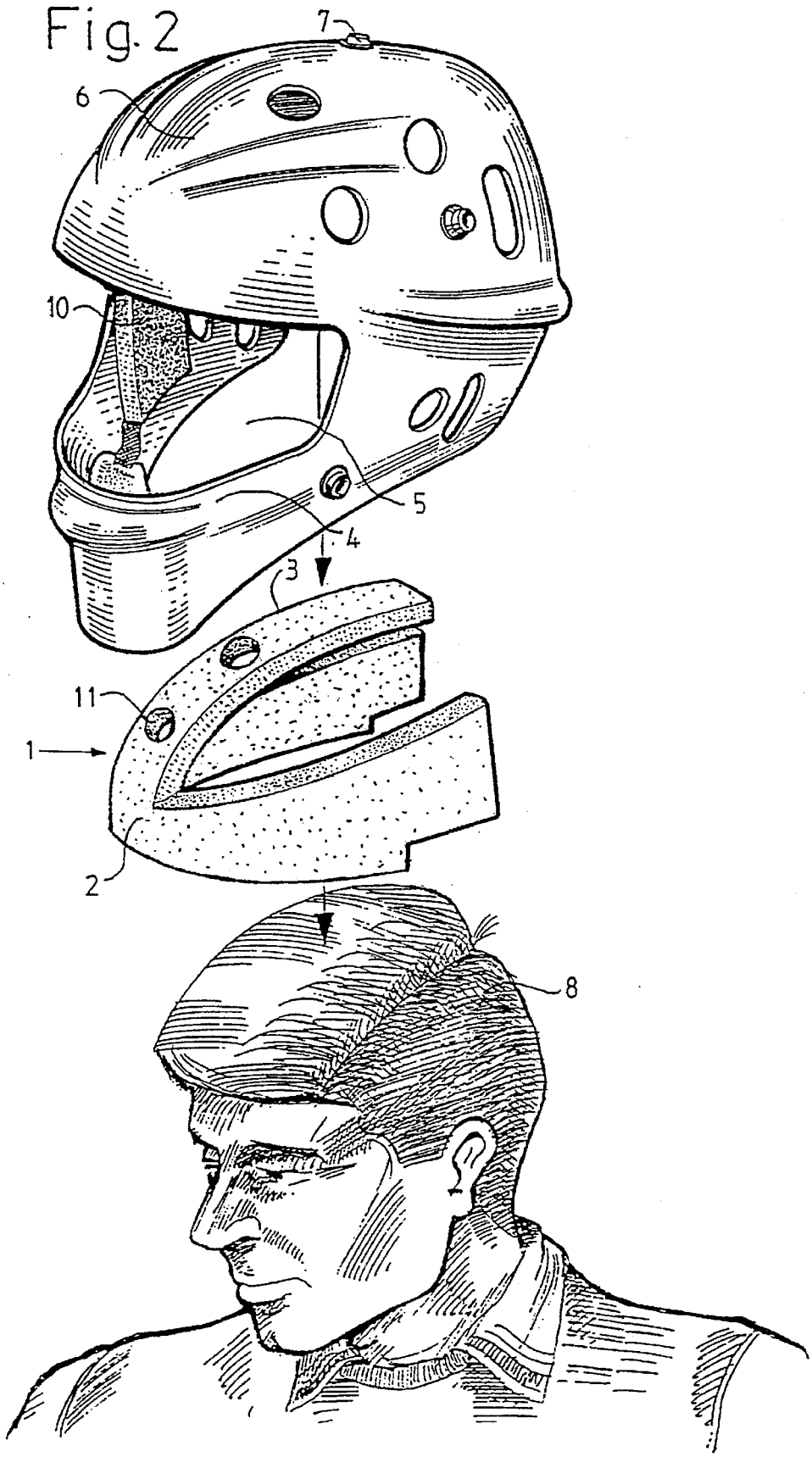
FIG. 2 illustrates an inventive method of manufacture.

The term helmet as used in the aforegoing and in the following includes both conventional helmets and face masks for ice-hockey goal tenders, see FIG. 2, which include a face-protecting part 4, which may either be provided with small eye openings or, as shown, a larger opening 5 which is intended to be covered by means of a grid or a visor structure, not shown. The face part 4 merges integrally with a crown guard 6 which part of the helmet is intended also to protect the sides of the head. Although not shown, the neck is normally protected by means of a plate attached to the helmet part 6 by means of fasteners 7.

Figure 3:
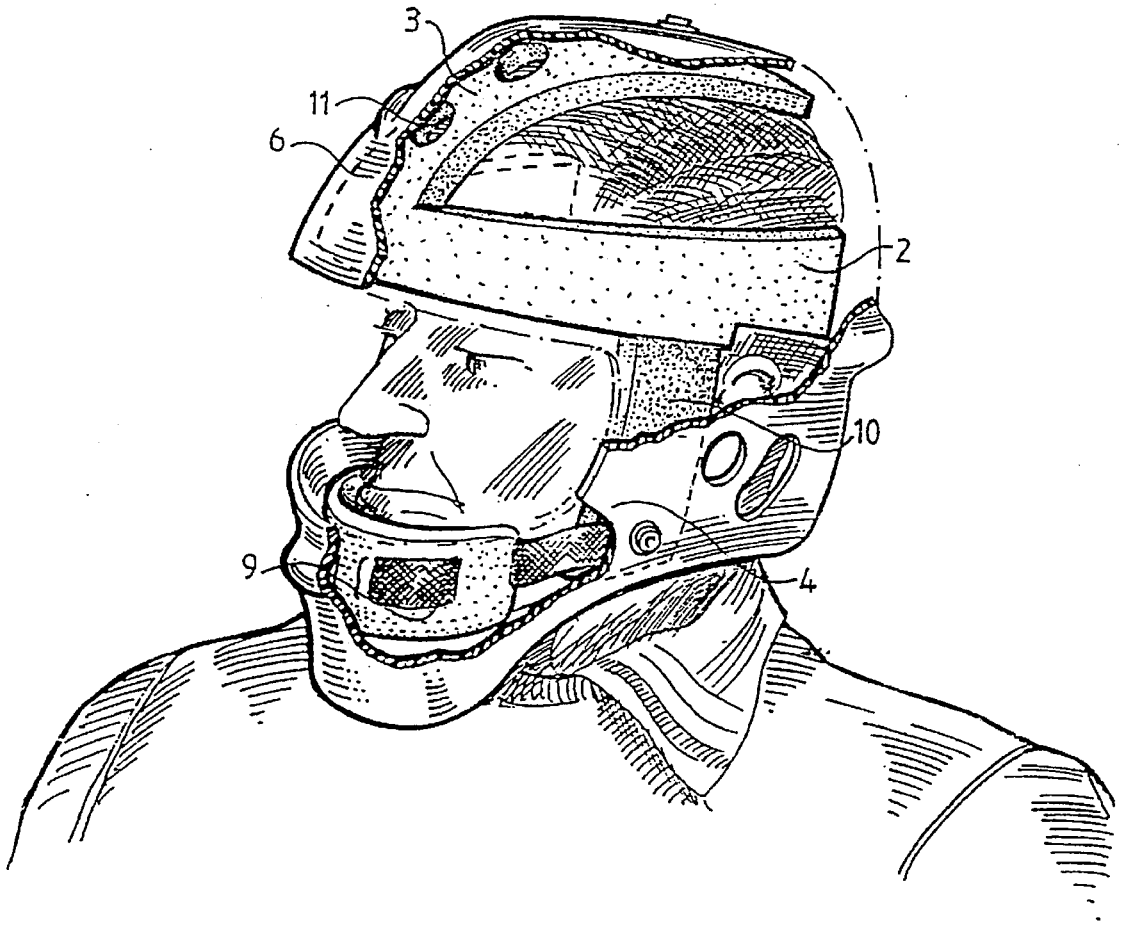
FIG. 3 is a partially sectioned view of a helmet provided with padding in accordance with the invention.

The padding 1 is fitted to the helmet shell by first heating the padding in an oven or like apparatus, so as to bring the padding to a soft and easily shaped state. In the case of the type of material defined above, the blank can be heated at a temperature of 100°–150° C. for 5–20 minutes suitably at 125° C., for about 10 minutes. The padding is then removed from the oven and placed in its correct position in the helmet shell and brought roughly to the shape of the shell. The helmet shell and the padding mounted therein are then placed on the wearer's head 8 and pressed forcibly against the head while keeping the helmet correctly positioned. The inner shape of the padding will therewith conform precisely to the shape of the head 8 at the same time as the outer surface of the padding will accurately conform to the inner surface of the helmet shell. This is illustrated in FIG. 3, in which certain parts of the shell and the padding have been cut away for the sake of illustration. The helmet is held pressed against the head until the padding has cooled to a temperature at which the material will retain its shape.

An extremely good fit is achieved between the padding and the head of the wearer and also the helmet shell when practicing the aforedescribed method. After being shaped, the padding is fixed to the helmet shell with the aid of suitable fasteners provided on the padding and/or the shell. These fasteners may comprise, for instance, double-sided adhesive tape, a suitable glue or tape of the Velcro® type which will enable the padding to be secured in precisely the correct position in the helmet shell. In the case of face masks of the illustrated kind, it is particularly important to achieve a good fit between the helmet padding and the forehead of the wearer, since forces acting on the front of the face mask are intended to be taken-up by the chin and the forehead of the wearer via the padded chin strap 9 attached to the helmet shell, as shown in FIG. 3. The remainder of the face-covering part 4 of the mask shall be spaced from the face of the wearer. The reference numeral 10 identifies padding firmly affixed to the sides of the mask. This padding can also be formed in accordance with the present invention if so desired.

As indicated in the aforegoing, it has been surprisingly found that if required the padding can be heated to a temperature of up to 150° C., and still use the head of the individual concerned as a molding tool when shaping the padding to fit the head and helmet. Among other things, this is because the surface of material of the aforesaid kind cools very rapidly when the padding blank is removed from the oven and placed in the helmet shell so that the helmet can be pressed on the head of the individual concerned without causing appreciable discomfort to the wearer. If the individual concerned has very sensitive skin, the skin can be protected in some suitable manner, for instance with the aid of thin gauze. If the individual concerned wishes to wear a thin cap beneath the helmet, the cap can be placed on the head of the wearer when shaping the helmet padding.

The illustrated blank 1 includes two holes 11 which are intended to take-up material flow in the padding occurring as the blank is pressed against the head of the wearer. This greatly facilitates final shaping of the padding. It will be understood that if necessary more than two holes can be provided and that the holes can be shaped and positioned as required.

The padding must not be heated to a temperature at which the material becomes so soft as to cause the material to flatten and become too thin when shaping the blank against the head of the wearer, and the highest temperature to which the padding can be heated is thus limited to such temperatures. This problem does not exist when shaping products industrially, since in this case there are normally used moulding tools whose moulding chambers have a predetermined precise volume.

It will be understood that the described and illustrated embodiment of the invention can be modified in several respects within the scope of the Claims. For instance, other types of thermoplastic material can be used and the shape of the padding blank can be varied as desired.

We claim:

1. A method of providing a helmet shell with impact-absorbing padding while adapting the padding to the shape of a human head, comprising the steps of;

a) cutting a padding blank from a sheet of thermoplastic material of appropriate hardness;

b) providing a plurality of cavities (11) in the blank sufficiently large to accommodate a flow of the thermoplastic material during a final shaping of the blank;

c) heating the blank to a temperature at which it softens and becomes readily moldable;

d) placing the blank in the helmet shell;

e) placing the helmet shell carrying the blank on a head;

f) pressing the helmet against the head with a force sufficient to mold the blank to the shape of the head and to the shape of the helmet shell;

g) maintaining said force until the blank has cooled to a temperature at which the material will retain its molded shape; and f) affixing the padding to the helmet shell with fastening means.

2. A method according to claim 1, wherein the thermoplastic material used is cellular polyethylene with a closed cell structure.

3. A method according to claim 1, wherein the padding blank is heated in an oven at a temperature of 100°–150° C., for 5–20 minutes.

4. A method according to claim 3, wherein the padding blank is heated in an oven at a temperature of 125° C., for about 10 minutes.

* * * * *